US011212608B2

(12) United States Patent
Tanaka

(10) Patent No.: US 11,212,608 B2
(45) Date of Patent: Dec. 28, 2021

(54) NOISE ELIMINATION DEVICE AND NOISE ELIMINATION METHOD

(71) Applicant: MITSUBISHI ELECTRIC CORPORATION, Tokyo (JP)

(72) Inventor: Nobuaki Tanaka, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 22 days.

(21) Appl. No.: 16/624,065

(22) PCT Filed: Aug. 10, 2017

(86) PCT No.: PCT/JP2017/029091
§ 371 (c)(1),
(2) Date: Dec. 18, 2019

(87) PCT Pub. No.: WO2019/030898
PCT Pub. Date: Feb. 14, 2019

(65) Prior Publication Data

US 2021/0168490 A1 Jun. 3, 2021

(51) Int. Cl.
*H04R 1/10* (2006.01)
*H04R 1/40* (2006.01)
*H04R 3/00* (2006.01)

(52) U.S. Cl.
CPC ..... *H04R 1/1083* (2013.01); *H04R 1/406* (2013.01); *H04R 3/005* (2013.01); *H04R 2410/05* (2013.01); *H04R 2430/25* (2013.01)

(58) Field of Classification Search
CPC .... H04R 1/406; H04R 2410/05; H04R 3/005; H04R 1/1083; H04R 2430/25
See application file for complete search history.

(56) References Cited

U.S. PATENT DOCUMENTS

2009/0055170 A1 2/2009 Nagahama
2013/0216064 A1 8/2013 Kim

FOREIGN PATENT DOCUMENTS

CN 101238511 A 8/2008
EP 1 923 866 A1 5/2008
(Continued)

OTHER PUBLICATIONS

Translation of JP3484112, "Noise component suppression processing apparatus and noise component suppression processing method", 2004 (Year: 2004).*

(Continued)

*Primary Examiner* — Regina N Holder
(74) *Attorney, Agent, or Firm* — Birch, Stewart, Kolasch & Birch, LLP

(57) ABSTRACT

A microphone array (3) having microphones (2) observing sound and a noise elimination processing unit (5) obtaining a sound of interest by eliminating noise from the observed sound signal are provided. The two microphones (2) which are adjacent to each other from among the plurality of microphones (2) have a positional relationship in such a manner that, in a plane (12) including the two microphones (2), a sound-of-interest source (A) generating a sound of interest, and a noise source (B) generating noise, the perpendicular bisector (13) of a first line segment (10) connecting the two microphones (2) coincides with the bisector of the angle θ between a second line segment (14) connecting the sound-of-interest source (A) and the midpoint (11) of the first line segment (10) and a third line segment (15) connecting the noise source (B) and the midpoint (11) of the first line segment (10).

5 Claims, 12 Drawing Sheets

(56) References Cited

FOREIGN PATENT DOCUMENTS

| | | | |
|---|---|---|---|
| JP | 3484112 | B2 * | 1/2004 |
| JP | 2008-76246 | A | 4/2008 |
| JP | 2010-271073 | A | 12/2010 |
| JP | 2013-546247 | A | 12/2013 |

OTHER PUBLICATIONS

Office Action dated Nov. 13, 2020 in the corresponding Chinese Patent Application No. 201780093677.6 with an English Translation.

Office Action issued in the corresponding German Patent Application No. 11 2017 007 733.8 dated Sep. 28, 2020 with English Translation.

Tanaka et al., "Development of Zonal Beamformer and Its Application to Robot Audition", Proc. EUSIPCO 2010, total 7 pages.

Tanaka et al., "Spatial filter calibration based on minimization of modified LSD", Proc. Interspeech 2011, total 8 pages.

Chinese Office Action for Chinese Application No. 201780093677.6, dated Jun. 22, 2021, with English translation.

* cited by examiner

NOISE ELIMINATION DEVICE AND NOISE ELIMINATION METHOD

TECHNICAL FIELD

The present invention relates to a technique for eliminating noise other than a target sound from sounds coming from a plurality of sound sources.

BACKGROUND ART

A noise elimination technique makes it easy to hear a target sound (hereinafter referred to as a sound of interest) by eliminating noise from sound data recorded using an acoustic sensor such as a microphone. The technique makes it possible to clarify voice that is hard to hear because of noise generated from apparatuses such as an air-conditioner or to extract the voice of a target speaking person when several people are speaking at the same time.

The noise elimination technique can also improve robustness against noise in a voice recognition system or the like. In addition, the noise elimination technique can be used for preventing deterioration of detection accuracy due to ambient noise in, for example, an apparatus monitoring system that automatically detects whether an abnormal sound is included in the operating sound of an apparatus.

As a method for eliminating noise from sound data, there is a method in which an acoustic sensor array is constituted by a plurality of acoustic sensors, and signal processing by software is performed on observation signals obtained from the acoustic sensors to form directivity with respect to a sound-of-interest source. This method has an advantage that sharp directivity can be formed while using an inexpensive acoustic sensor such as an omnidirectional microphone, whereby cost of hardware can be suppressed. Further, the formed directivity can be dynamically changed by software, and even when the sound source moves, noise can be eliminated from the sound data.

In the method for eliminating noise with a plurality of acoustic sensors, it is known that the noise elimination performance varies depending on a method of arranging acoustic sensors constituting the acoustic sensor array. For example, Patent Literature 1 discloses a multi-beam acoustic system using a technique in which an acoustic sensor array is arranged at a predetermined position so as to correspond to any two of seats installed in a vehicle. In Patent Literature 1, the predetermined position is a specific position between arbitrary two seats and is on a line perpendicular to the direction of the arbitrary two seats.

CITATION LIST

Patent Literatures

Patent Literature 1: JP 2013-546247 A

SUMMARY OF INVENTION

Technical Problem

In the multi-beam acoustic system disclosed in Patent Literature 1 described above, the positional relationship between the acoustic sensor array and a plurality of sound sources for obtaining high noise elimination performance is considered. However, even if the positional relationship between the acoustic sensor array and the plurality of sound sources is set as disclosed in Patent Literature 1, noise elimination performance may be degraded due to distortion in an output signal, depending on the positional relationship between the acoustic sensors constituting the acoustic sensor array and the plurality of sound sources. Patent Literature 1 does not disclose how to determine positional relationship between the acoustic sensors constituting the acoustic sensor array and the plurality of sound sources in order to obtain high noise elimination performance. Therefore, the conventional noise elimination device still has a problem of degradation in noise elimination performance due to distortion in an output signal.

The present invention has been made to solve the above-described problems, and an object of the present invention is to suppress distortion in an output signal and improve noise elimination performance in a noise elimination device provided with an acoustic sensor array.

Solution to Problem

A noise elimination device according to the present invention includes: an acoustic sensor array having a plurality of acoustic sensors observing sound signals; and processing circuitry to obtain a sound of interest by eliminating noise from the sound signals observed by the plurality of acoustic sensors. Two acoustic sensors which are adjacent to each other from among the plurality of acoustic sensors have a positional relationship in such a manner that, in a plane including the two acoustic sensors, a sound-of-interest source generating a sound of interest, and a noise source generating noise, a perpendicular bisector of a first line segment connecting the two acoustic sensors coincides with a bisector of an angle between a second line segment connecting the sound-of-interest source to a midpoint of the first line segment and a third line segment connecting the noise source to the midpoint of the first line segment.

Advantageous Effects of Invention

According to the present invention, the acoustic sensors and the sound sources can be arranged at positions where distortion in an output signal is suppressed, and thus, noise elimination performance can be improved.

DESCRIPTION OF EMBODIMENTS

Hereinafter, in order to describe the present invention in more detail, some embodiments for carrying out the present invention will be described with reference the accompanying drawings.

First Embodiment

Figure 1:
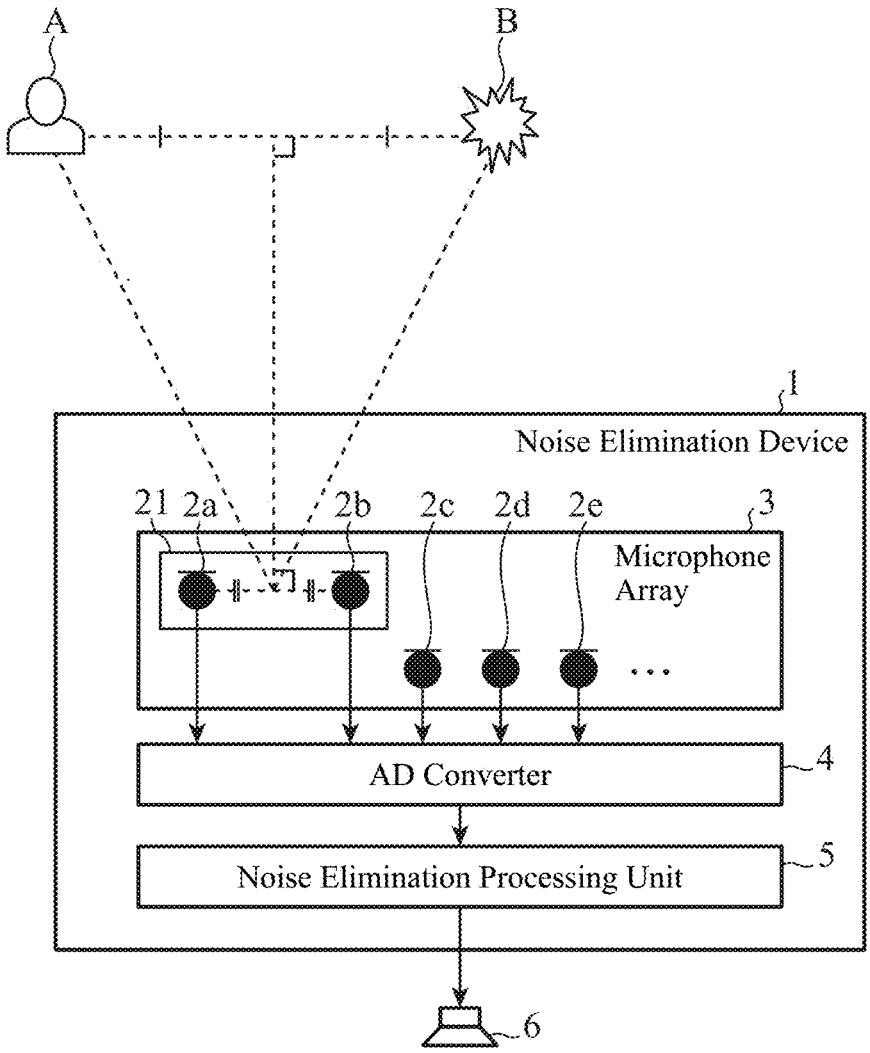
FIG. 1 is a diagram showing a configuration of a noise elimination device according to a first embodiment.

FIG. 1 is a diagram showing a configuration of a noise elimination device 1 according to a first embodiment of the present invention.

The present embodiment will be described using a microphone as a specific example of an acoustic sensor, and a microphone pair is assumed as an acoustic sensor pair, and a microphone array is assumed as an acoustic sensor array. However, the acoustic sensor in the present invention is not limited to a microphone, and may be an ultrasonic sensor, for example.

The noise elimination device 1 includes a microphone array 3 including two or more microphones 2 (microphones 2*a*, 2*b*, 2*c*, 2*d*, 2*e*, . . . ), an AD converter 4, and a noise elimination processing unit 5. A signal of sound (observation signal) observed by the microphone 2 of the noise elimination device 1 is input to the AD converter 4. The AD converter 4 converts the input observation signal into a digital signal and outputs the digital signal to the noise elimination processing unit 5. The noise elimination processing unit 5 eliminates a noise signal from the observation signal converted into a digital signal. The noise elimination processing unit 5 outputs the observation signal from which the noise signal is eliminated to a speaker 6 connected to the noise elimination device 1 as an output signal.

Next, the configuration of the microphone 2 will be described.

FIG. 1 shows a plurality of microphones 2*a*, 2*b*, 2*c*, 2*d*, 2*e*, . . . (referred to as the microphones 2 when a plurality of microphones is collectively described). A set of two microphones 2*a* and 2*b* adjacent to each other among the plurality of microphones 2 is referred to as a microphone pair 21. The microphone pair 21 may consist of at least one set of microphones 2 adjacent to each other among the plurality of microphones 2. The position where at least one microphone pair 21 is located is determined depending on the positions of a sound-of-interest source A that generates a sound of interest and a noise source B that generates noise. In the following description, it is assumed that the positional relationship among the sound-of-interest source A, the noise source B, and the microphone pair 21 is known. Note that the positions where the other microphones 2*c*, 2*d*, 2*e*, . . . other than the microphones 2*a* and 2*b* constituting the microphone pair 21 are arranged can be freely set.

The positional relationship among the microphone 2*a*, the microphone 2*b*, the sound-of-interest source A, and the noise source B by which the highest noise elimination performance is achieved when the noise elimination processing unit 5 of the noise elimination device 1 performs noise elimination using one microphone pair 21 will be described with reference to FIG. 2.

Figure 2:
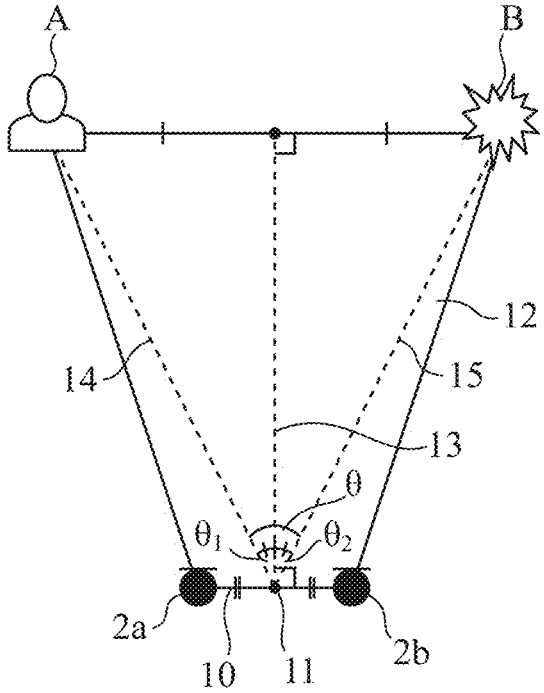
FIG. 2 is a diagram showing an example of arrangement of microphones of the noise elimination device according to the first embodiment.

FIG. 2 is a diagram showing an example of arrangement of the microphones 2 of the noise elimination device 1 according to the first embodiment of the present invention.

A line segment connecting the microphone 2*a* and the microphone 2*b* that constitute the microphone pair 21 is defined as a first line segment 10. More specifically, a line segment connecting the centers of the microphone 2*a* and the microphone 2*b* is defined as the first line segment 10, for example. The midpoint of the first line segment 10 is defined as a midpoint 11. Note that the center of the microphone 2*a* and the center of the microphone 2*b* are not necessarily exact centers.

A plane including the microphone 2*a*, the microphone 2*b*, the sound-of-interest source A, and the noise source B is defined as a plane 12. More specifically, for example, a plane including the centers of the microphone 2*a* and the microphone 2*b*, a point arbitrarily set on the sound-of-interest source A (hereinafter referred to as a set point of the sound-of-interest source A), and a point arbitrarily set on the noise source B (hereinafter referred to as a set point of the noise source B) is defined as the plane 12.

In the plane 12, a perpendicular bisector 13 of the first line segment 10 coincides with the bisector of the angle θ between a second line segment 14 connecting the sound-of-interest source A to the midpoint 11 and a third line segment 15 connecting the noise source B to the midpoint 11. More specifically, the perpendicular bisector 13 coincides with the bisector of the angle θ between the second line segment 14 connecting the set point of the sound-of-interest source A to the midpoint 11 and the third line segment 15 connecting the set point of the noise source B to the midpoint 11, for example.

The angle $\theta_1$ formed by the perpendicular bisector 13 and the second line segment 14 indicates the direction from which a sound of interest generated by the sound-of-interest source A comes to the microphone pair 21 with respect to the perpendicular bisector 13. Hereinafter, the angle $\theta_1$ is defined as a sound-of-interest incoming direction $\theta_1$.

The angle θ2 formed by the perpendicular bisector 13 and the third line segment 15 indicates the direction from which noise generated by the noise source B comes to the microphone pair 21 with respect to the perpendicular bisector 13. Hereinafter, the angle θ2 is defined as a noise incoming direction $\theta_2$. FIG. 2 shows a case where the sound-of-interest incoming direction $\theta_1$ and the noise incoming direction $\theta_2$ have the same angle.

When the microphone 2*a* and the microphone 2*b* are arranged so that the microphone 2*a*, the microphone 2*b*, the sound-of-interest source A, and the noise source B are all on the same plane 12, and that the value of the sound-of-interest incoming direction $\theta_1$ and the value of the noise incoming direction $\theta_2$ are the same, the maximum noise elimination performance of the noise elimination processing unit 5 can be achieved.

FIG. 2 shows the case where the lengths of the second line segment 14 and the third line segment 15 are equal, and the midpoint 11, the set point of the sound-of-interest source A, and the set point of the noise source B are at the vertices of an isosceles triangle. However, the arrangement is not limited to the example shown in FIG. 2, and the lengths of the second line segment 14 and the third line segment 15 may be different from each other. That is, the distance from the midpoint 11 to the set point of the sound-of-interest source A and the distance from the midpoint 11 to the set point of the noise source B may be different.

Next, the relationship between the incoming direction of a sound observed by the microphone pair 21 and time difference will be described with reference to FIG. 3 and FIG. 4.

Figure 3:
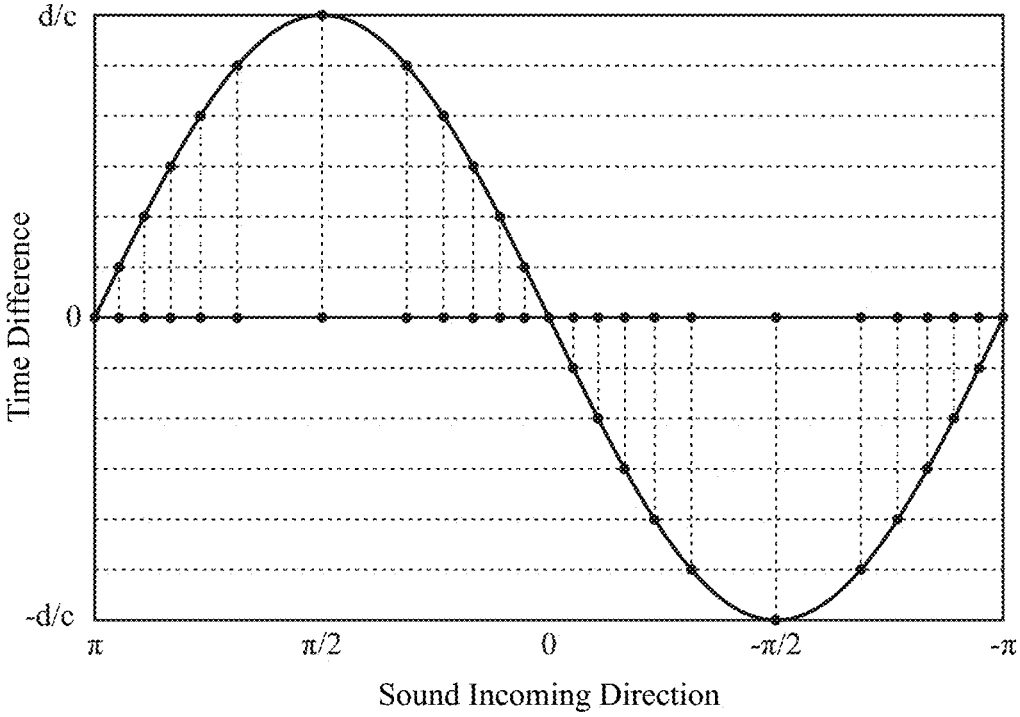
FIG. 3 is a diagram showing a relationship between incoming directions of a sound observed by a microphone pair of the noise elimination device and time difference according to the first embodiment.

FIG. 3 is a diagram showing a relationship between an incoming direction of sound observed by the microphone pair 21 of the noise elimination device 1 and time difference according to the first embodiment of the present invention.

In FIG. 3, scale lines are marked at equal intervals on the vertical axis representing the time difference, and points are graphed for incoming directions of sounds corresponding to time difference values on the scale line. As shown in FIG. 3, the incoming directions at the positions of the points are unevenly spaced. Here, the sound incoming direction includes the sound-of-interest incoming direction $\theta_1$ and the noise incoming direction $\theta_2$. In the following, a value of angle is expressed in radians.

Figure 4:
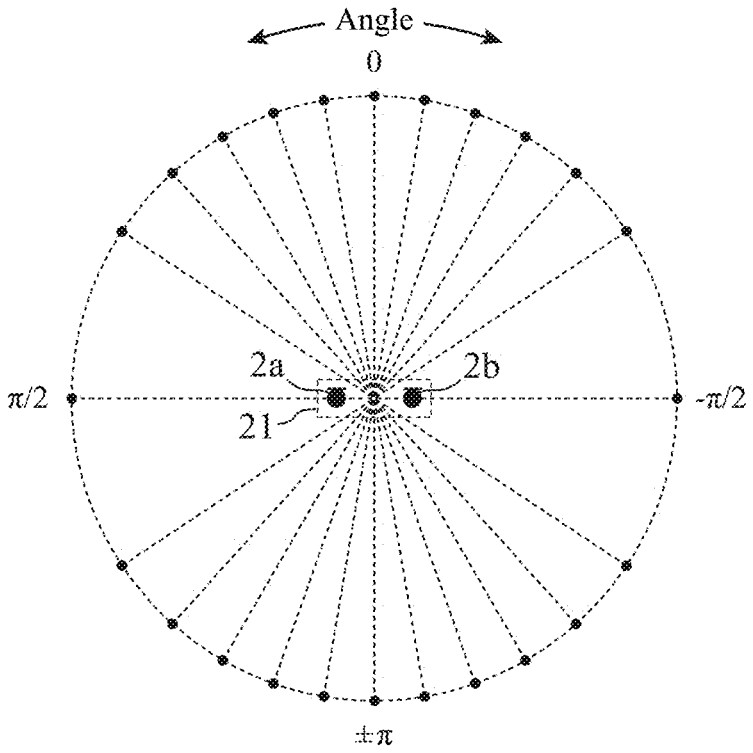
FIG. 4 is a diagram in which sound incoming directions are plotted on the circumference around a microphone array of the noise elimination device according to the first embodiment.

FIG. 4 is a diagram in which the sound incoming directions shown in FIG. 3 are plotted on a circumference around the microphone array 3 of the noise elimination device 1 according to the first embodiment of the present invention.

As shown in FIG. 4, the distribution of points is dense when the sound incoming direction is near 0 or $\pm\pi$, and is sparse when the sound incoming direction is near$\pm\pi/2$. For example, when the time difference of the observed sound signal deviates from the actual time difference by one scale in FIG. 3 due to the influence of noise, either of the points on both sides of the point corresponding to the actual sound incoming direction in FIG. 4 is calculated as the observed value of the sound incoming direction.

In this case, in FIG. 4, in the range of 0 or $\pm R$ direction where the distribution of points is dense, the observed value of the sound incoming direction does not fluctuate greatly even if a variation occurs in the time difference. On the other hand, in FIG. 4, in the range of $\pm\pi/2$ direction where the distribution of points is sparse, the observed value of the sound incoming direction fluctuates greatly due to even a slight variation in the time difference. In other words, in a situation where a certain variation occurs in time difference, when the sound source is positioned close to 0 or $\pm R$ direction, only a small error occurs in the observed value of the sound incoming direction (a variation in the observed value is small), whereas when the sound source is positioned close to $\pm\pi/2$ direction, a great error occurs in the observed value of the sound incoming direction (a variation in the observed value is great). This means that the shape of the histogram of the observed values of the incoming directions of sounds observed by the microphone pair 21 depends on which range the actual sound incoming direction exists.

FIG. 5 is a histogram showing observed values of incoming directions of sounds observed by the microphone pair 21 of the noise elimination device 1 according to the first embodiment of the present invention.

Figure 5A:
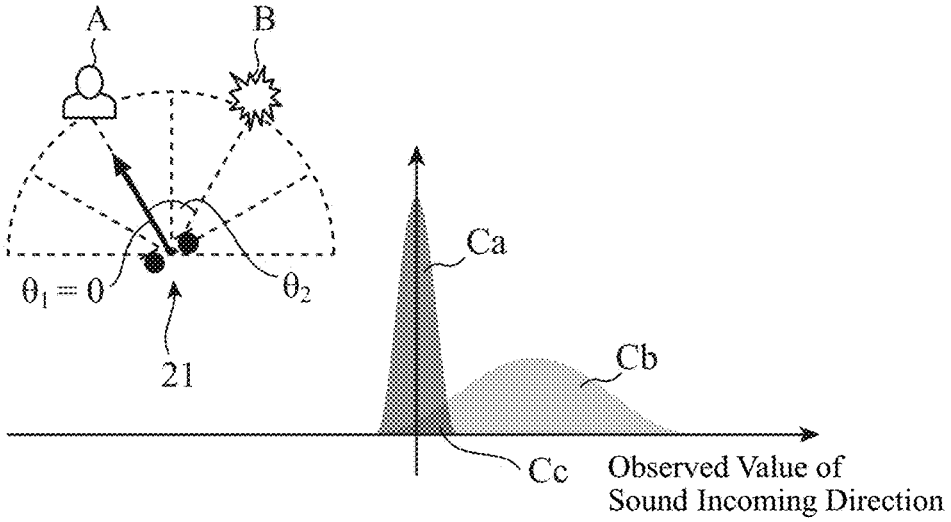
FIGS. 5A, 5B, and 5C are histograms showing observed values of incoming directions of sounds observed by the microphone pair of the noise elimination device according to the first embodiment.
Figure 5B:
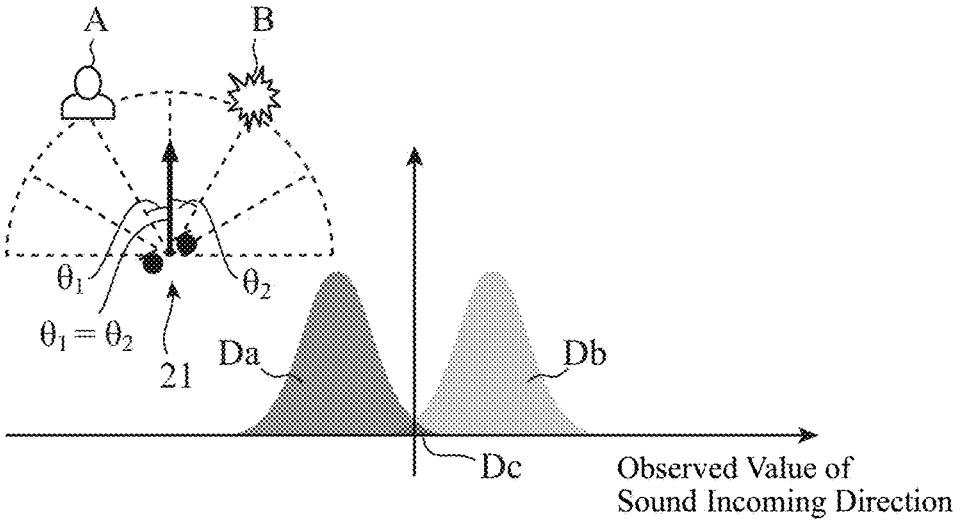
Figure 5C:
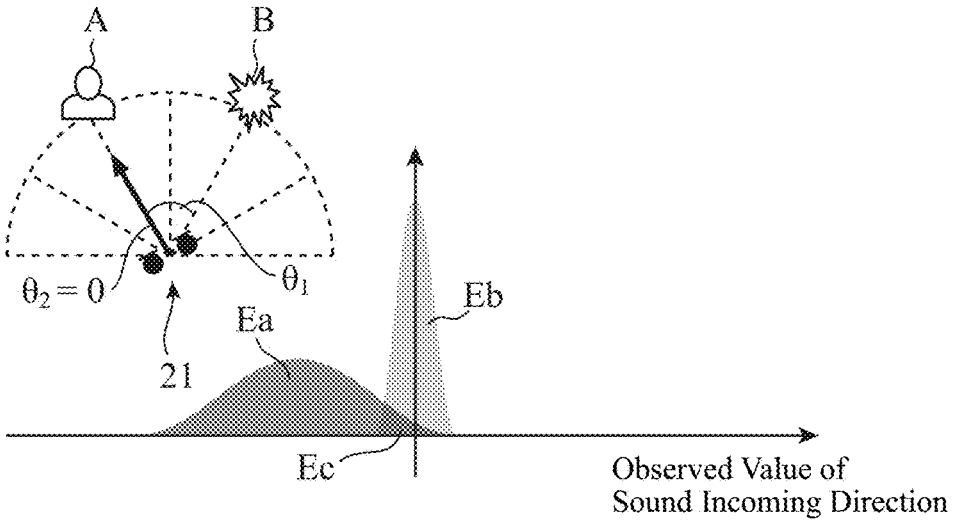

FIGS. 5A to 5C show the distribution (uncertainty) of observed values of incoming directions of sounds obtained by the microphone pair 21 observing sound waves coming from the sound-of-interest source A and the noise source B when the microphone pair 21 is oriented in a preset direction relative to the sound-of-interest source A and the noise source B.

FIG. 5A shows the case where the microphone pair 21 faces the direction of the sound-of-interest source A, that is, the case where the sound-of-interest incoming direction $\theta_1=0$.

In the case of FIG. 5A, since the sound-of-interest incoming direction $\theta_1$ is 0, the histogram of observed values of incoming directions of incoming sounds of interest has a distribution with a sharp peak as indicated by a distribution Ca in FIG. 5A.

On the other hand, since the noise incoming direction $\theta_2$ is located in the $-\pi/2$ direction with respect to 0 (see FIG. 4), the histogram of observed values of incoming directions of incoming noise has a gentle distribution as indicated by a distribution Cb in FIG. 5A.

The distribution Ca in the histogram of observed values of incoming directions of incoming sounds of interest and the distribution Cb in the histogram of observed values of incoming directions of incoming noise overlap each other in a region Cc. The area of the region Cc is proportional to an amount of distortion included in the output signal output from the noise elimination device 1.

FIG. 5B shows the case where the microphone pair 21 faces the direction between the sound-of-interest source A and the noise source B, that is, the case where the value of the sound-of-interest incoming direction $\theta_1$ is equal to the value of the noise incoming direction $\theta_2$.

Since the value of the sound-of-interest incoming direction $\theta_1$ and the value of the noise incoming direction $\theta_2$ are the same, the histogram of observed values of incoming directions of incoming sounds of interest and the histogram of observed values of incoming directions of incoming noise have distributions Da and Db, respectively, which are the same in shape. The distribution Da in the histogram of observed values of incoming directions of incoming sounds of interest and the distribution Db in the histogram of observed values of incoming directions of incoming noise overlap each other in a region Dc.

FIG. 5C shows the case where the microphone pair 21 faces the direction of the noise source B, that is, the case where the noise incoming direction $\theta_2=0$.

In the case of FIG. 5C, since the sound-of-interest incoming direction $\theta_1$ is located in the $\pi/2$ direction with respect to 0 (see FIG. 4), the histogram of observed values of incoming directions of incoming sounds of interest has a gentle distribution as indicated by a distribution Ea in FIG. 5C.

On the other hand, since the noise incoming direction $\theta_2$ is 0, the histogram of observed values of incoming directions of incoming noise has a distribution with a sharp peak as indicated by a distribution Eb in FIG. 5C.

The distribution Ea in the histogram of observed values of incoming directions of incoming sounds of interest and the distribution Eb in the histogram of observed values of incoming directions of incoming noise overlap each other in a region Ec.

Comparing the areas of the three regions Cc, Dc, and Ec shown in FIGS. 5A to 5C, the area of the region Dc shown in FIG. 5B is the smallest. That is, when the microphone pair 21 is arranged to face the direction between the sound-of-interest source A and the noise source B as shown in FIG. 5B, distortion included in the output signal output from the noise elimination device 1 is minimized.

Note that the case where the microphone pair 21 is arranged to face the direction between the sound-of-interest source A and the noise source B specifically means that, in the plane 12 shown in FIG. 2, the perpendicular bisector 13 of the first line segment 10 coincides with the bisector of the angle θ between the second line segment 14 connecting the sound-of-interest source A to the midpoint 11 and the third line segment 15 connecting the noise source B to the midpoint 11.

FIG. 5B shows that the sound-of-interest incoming direction $\theta_1$ and the noise incoming direction $\theta_2$ have the same value. However, the sound-of-interest incoming direction $\theta_1$ and the noise incoming direction $\theta_2$ do not necessarily have the same value exactly, and a little angular variation is allowed.

As described above, when the microphones 2*a* and 2*b* constituting the microphone pair 21 are arranged so that, in the plane 12, the perpendicular bisector 13 of the line segment connecting the centers of the microphones 2*a* and 2*b* which are adjacent to each other coincides with the bisector of the angle θ between the second line segment 14 connecting the sound-of-interest source A to the midpoint 11 and the third line segment 15 connecting the noise source B to the midpoint 11, the noise elimination performance of the noise elimination device 1 can be maximized.

For example, when the driver's voice is observed with the microphones 2 mounted on a vehicle, the microphone pair 21 is arranged as follows. First, suppose that the seating position of the driver who is the sound-of-interest source A is known, the position of a vehicle engine sound generation source that is the noise source B is known, and the noise elimination device 1 eliminates the vehicle engine sound. The microphone pair 21 is arranged so that, in the plane 12 including the microphones 2*a* and 2*b* adjacent to each other, the sound-of-interest source A, and the noise source B, the perpendicular bisector 13 of the first line segment 10 connecting the microphones 2*a* and 2*b* adjacent to each other coincides with the bisector of the angle θ between the second line segment 14 connecting the sound-of-interest source A to the midpoint 11 of the first line segment 10 and the third line segment 15 connecting the noise source B to the midpoint 11 of the first line segment 10. Thus, the noise elimination device 1 can eliminate the vehicle engine sound with maximizing the noise elimination performance while minimizing distortion in an output signal.

The above description shows, as one example, the case where the noise elimination device 1 eliminates a vehicle engine sound as noise when observing the driver's voice. Instead of this configuration, the noise elimination device 1 may be configured to eliminate the voice of a passenger seated in a passenger seat as noise, or to eliminate a sound output from a speaker device mounted on the vehicle as noise.

Further, the noise elimination device 1 is not limited to be mounted on a vehicle, but can be used in an apparatus monitoring system or the like. In that case, the noise elimination device 1 obtains an operating sound of a monitoring target apparatus as a sound of interest, eliminates operating sounds of other apparatuses as noise, and can provide only the operating sound of the monitoring target apparatus to a monitoring process.

Returning back to the description of the configuration shown in FIG. 1, the noise elimination processing unit 5 will now be described.

The noise elimination processing unit 5 outputs an output signal obtained by eliminating noise from the observation signal input from the microphones 2 to the speaker 6. In general, when noise is eliminated using the microphone array 3, the noise elimination processing unit 5 observes the sound incoming direction for each time-frequency component on the basis of the time difference between the observation signals obtained from the plurality of microphones 2. Next, the noise elimination processing unit 5 multiplies the observation signals by a filter for eliminating time-frequency components constituting sounds coming from directions other than the target direction from the observation signals of the observed sounds.

Figure 6:
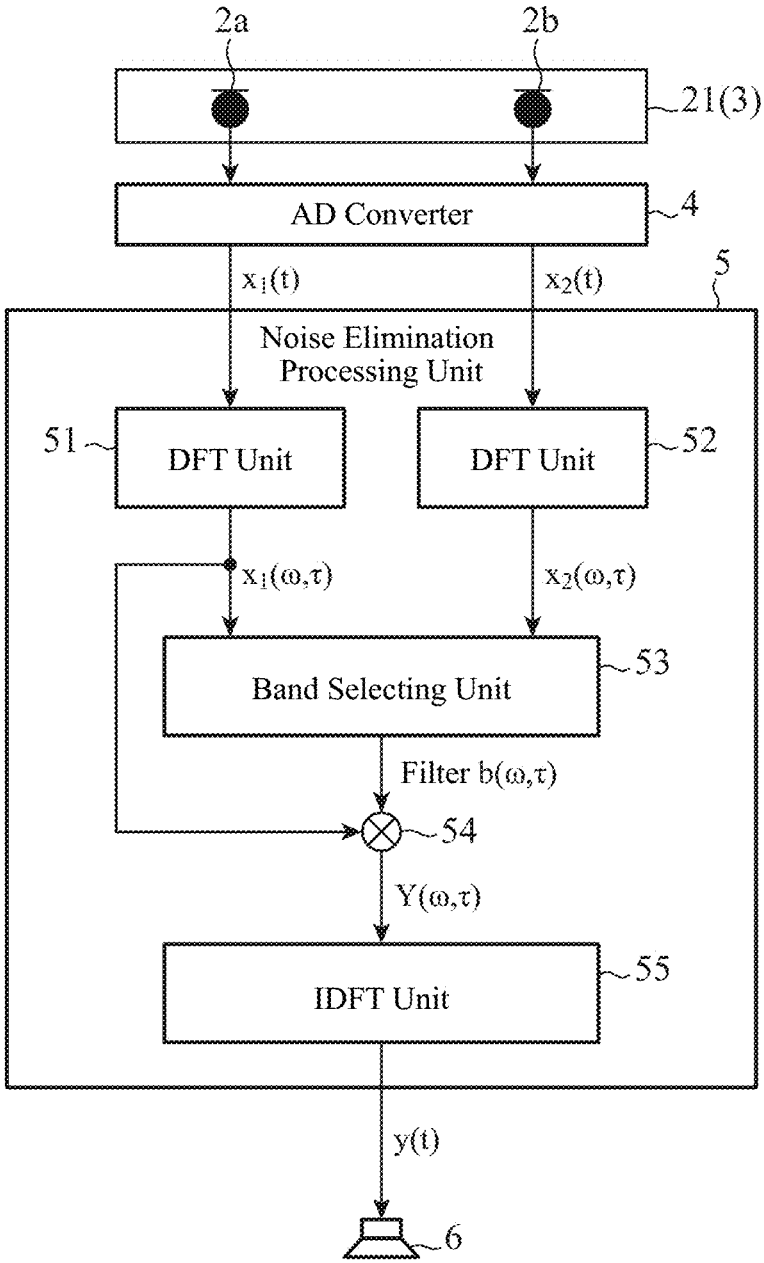
FIG. 6 is a block diagram of a noise elimination processing unit of the noise elimination device according to the first embodiment.

FIG. 6 is a block diagram of the noise elimination processing unit 5 of the noise elimination device 1 according to the first embodiment of the present invention.

The noise elimination processing unit 5 includes discrete Fourier transform (DFT) units 51 and 52, a band selecting unit 53, a multiplication unit 54, and an inverse discrete Fourier transform (IDFT) unit 55. Here, description will be given using the configuration shown in FIG. 6. However, the configuration of the noise elimination processing unit 5 is not limited to the configuration shown in FIG. 6, and other configurations may be adopted.

Further, in order to simplify the description, a case where the microphone array 3 includes two microphones 2 will be described below as an example. It is easy to extend the configuration so as to include three or more microphones 2, and the configuration including three or more microphones 2 is also included in the present invention. Suppose that the microphone 2*a* and the microphone 2*b* constitute the microphone array 3, and the microphone pair 21 is constituted by the two microphones 2*a* and 2*b*.

The DFT units 51 and 52 perform short-time discrete Fourier transform on the observation signal in time domain input from the AD converter 4 to obtain observation signal spectra $X_1(\omega, \tau)$ and $X_2(\omega, \tau)$ in frequency domain. The DFT units 51 and 52 output the obtained observation signal spectra $X_1(\omega, \tau)$ and $X_2(\omega, \tau)$ in frequency domain to the band selecting unit 53. Here, w represents a discrete frequency, and represents a short time frame. The band selecting unit 53 calculates a sound incoming direction $\theta(\omega, \tau)$ for each discrete frequency on the basis of the observation signal spectra $X_1(\omega, \tau)$ and $X_2(\omega, \tau)$ input from the DFT units 51 and 52. The band selecting unit 53 generates a filter $b(\omega, \tau)$ that leaves only the time-frequency component of the sound coming from the sound-of-interest direction on the basis of the sound incoming direction $\theta(\omega, \tau)$ for each calculated discrete frequency.

The multiplication unit 54 multiplies the observation signal spectrum $X_1(\omega, \tau)$ of the microphone 2*a* by the generated filter $b(\omega, \tau)$ to generate an output signal spectrum $Y(\omega, \tau)$ from which noise is eliminated. The multiplication unit 54 outputs the generated output signal spectrum $Y(\omega, \tau)$ to the IDFT unit 55. The IDFT unit 55 converts the output signal spectrum $Y(\omega, \tau)$ input from the multiplication unit 54 into an output signal y(t) in time domain by discrete inverse Fourier transform, and outputs the output signal y(t) to the speaker 6.

Next, a hardware configuration example of the noise elimination processing unit 5 will be described.

Figure 7A:
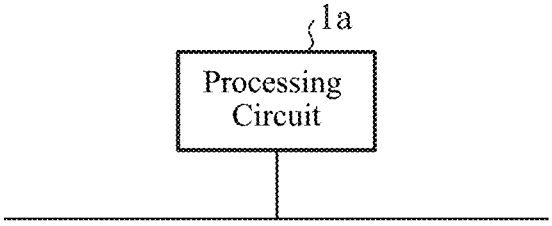
FIGS. 7A and 7B are diagrams showing a hardware configuration example of the noise elimination processing unit of the noise elimination device according to the first embodiment.
Figure 7B:
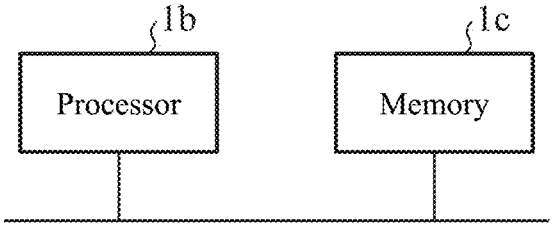

FIGS. 7A and 7B are diagrams showing hardware configuration examples of the noise elimination processing unit 5 of the noise elimination device 1 according to the first embodiment of the present invention.

The functions of the DFT units 51 and 52, the band selecting unit 53, the multiplication unit 54, and the IDFT unit 55 in the noise elimination processing unit 5 of the noise elimination device 1 are achieved by a processing circuit. That is, the noise elimination processing unit 5 of the noise elimination device 1 includes a processing circuit for achieving the above functions. The processing circuit may be a processing circuit 1*a* that is dedicated hardware as shown in FIG. 7A, or a processor 1*b* that executes a program stored in a memory 1*c* as shown in FIG. 7B.

When the DFT units 51 and 52, the band selecting unit 53, the multiplication unit 54, and the IDFT unit 55 in the noise elimination processing unit 5 are achieved by dedicated hardware as shown in FIG. 7A, the processing circuit 1*a* is, for example, a single circuit, a composite circuit, a programmed processor, a parallel programmed processor, an application specific integrated circuit (ASIC), a field-programmable gate array (FPGA), or a combination of some of these circuits. The functions of the DFT units 51 and 52, the band selecting unit 53, the multiplication unit 54, and the IDFT unit 55 in the noise elimination processing unit 5 may be achieved by respective processing circuits, or the functions of the respective units are collectively achieved by a single processing circuit.

When the DFT units 51 and 52, the band selecting unit 53, the multiplication unit 54, and the IDFT unit 55 in the noise elimination processing unit 5 are achieved by the processor 1*b* as shown in FIG. 7B, the functions of the respective units are achieved by software, firmware, or a combination of software and firmware. Software or firmware is described as a program and stored in the memory 1*c*. The processor 1*b* implements the functions of the DFT units 51 and 52, the band selecting unit 53, the multiplication unit 54, and the IDFT unit 55 in the noise elimination processing unit 5 by reading and executing the program stored in the memory 1*c*. That is, the DFT units 51 and 52, the band selecting unit 53, the multiplication unit 54, and the IDFT unit 55 in the noise elimination processing unit 5 includes a memory 1*c* for storing programs by which, when executed by the processor 1*b*, steps shown in FIG. 8 described later are consequently executed. In other words, these programs cause a computer to execute procedures or methods of the DFT units 51 and 52, the band selecting unit 53, the multiplication unit 54, and the IDFT unit 55 in the noise elimination processing unit 5.

Here, the processor 1*b* is, for example, a central processing unit (CPU), a processing device, an arithmetic device, a processor, a microprocessor, a microcomputer, or a digital signal processor (DSP).

The memory 1*c* is, for example, a nonvolatile or volatile semiconductor memory such as a random access memory (RAM), a read only memory (ROM), a flash memory, an erasable programmable ROM (EPROM), or an electrically EPROM (EEPROM), a magnetic disk such as a hard disk or a flexible disk, or an optical disk such as a mini disc, a compact disc (CD), or a digital versatile disc (DVD).

Note that only some portions of the functions of the DFT units 51 and 52, the band selecting unit 53, the multiplication unit 54, and the IDFT unit 55 in the noise elimination processing unit 5 may be implemented by dedicated hardware, and the other portions of the functions may be implemented by software or firmware. As described above, the processing circuit 1*a* in the noise elimination processing unit 5 can implement the above-mentioned functions by hardware, software, firmware, or a combination thereof.

Next, an operation of the noise elimination device 1 will be described with reference to the flowchart of FIG. 8.

Figure 8:
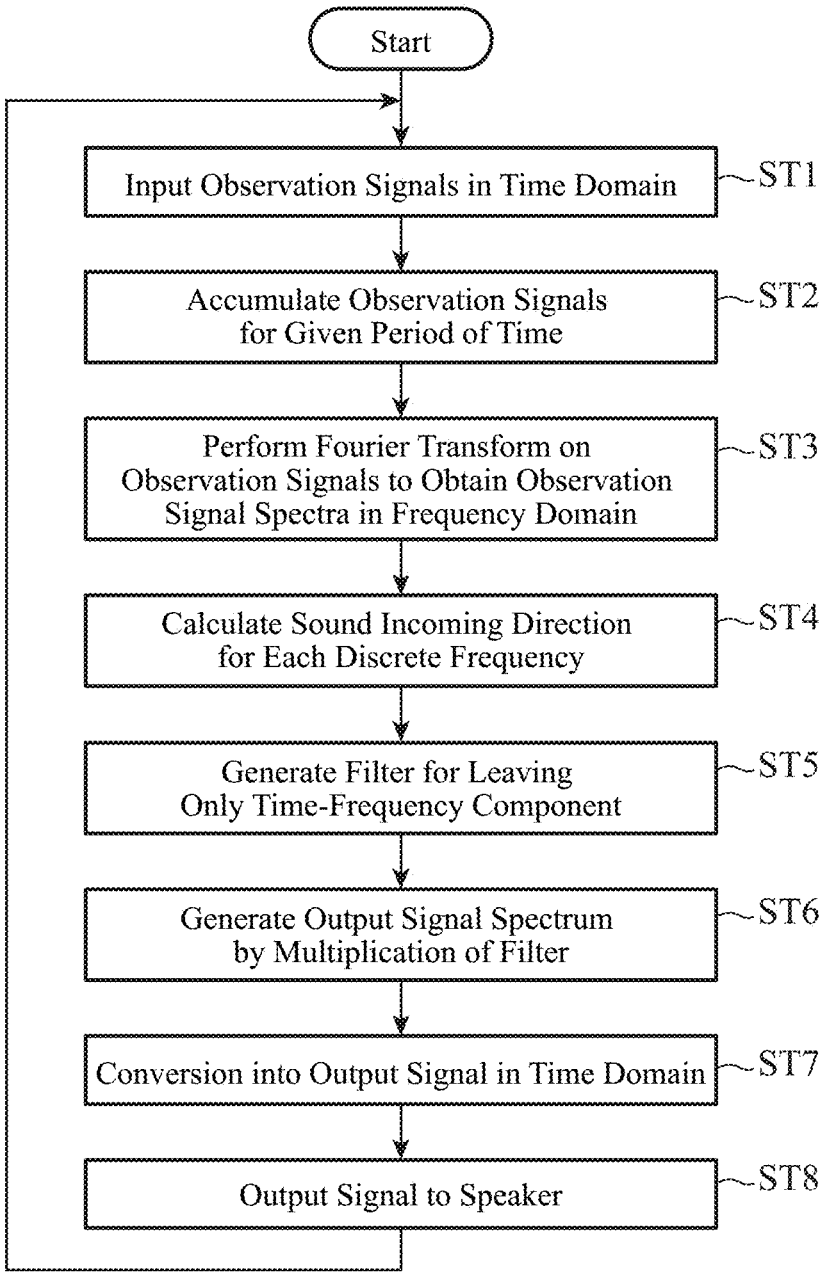
FIG. 8 is a flowchart showing an operation of the noise elimination device according to the first embodiment.

FIG. 8 is a flowchart showing the operation of the noise elimination device 1 according to the first embodiment of the present invention.

The operation shown in FIG. 8 is performed on a basis of the premise that the microphone pair 21 is arranged so that, in the plane 12 shown in FIG. 2, the perpendicular bisector 13 of the first line segment 10 coincides with the bisector of the angle θ between the second line segment 14 connecting the sound-of-interest source A to the midpoint 11 and the third line segment 15 connecting the noise source B to the midpoint 11.

Sounds collected by the microphones 2*a* and 2*b* constituting the microphone pair 21 are converted into digital signals by the AD converter 4 and input to the DFT units 51 and 52, respectively, as observation signals in time domain (step ST1). The DFT units 51 and 52 accumulate the observation signals input in step ST1 in a buffer or the like for a given period of time (for example, 0.1 sec) (step ST2). The observation signals in time domain obtained by the DFT units 51 and 52 from the microphones 2*a* and 2*b* at a time t are represented as $x_1(t)$ and $x_2(t)$, respectively. The DFT units 51 and 52 perform short-time discrete Fourier transform on the observation signals $x_1(t)$ and $x_2(t)$ accumulated in step ST2 so as to obtain observation signal spectra $X_1(\omega, \tau)$ and $X_2(\omega, \tau)$ in frequency domain (step ST3). The DFT units 51 and 52 output the observation signal spectra in frequency domain obtained in step ST3 to the band selecting unit 53.

The band selecting unit 53 calculates a sound incoming direction for each discrete frequency on the basis of the observation signal spectra $X_1(\omega, \tau)$ and $X_2(\omega, \tau)$ in frequency domain input from the DFT units 51 and 52 (step ST4). If the sound source is located at a position sufficiently away from the microphone array 3, the sound incoming direction $\theta(\omega, \tau)$ can be calculated on the basis of the phase difference between the observation signal spectra $X_1(\omega, \tau)$ and $X_2(\omega, \tau)$ in frequency domain as represented by the following Equation (1).

$$\theta(\omega, \tau) = \arcsin\left\{\frac{c}{2\pi\omega d}\arg\left(\frac{X_2(\omega, \tau)}{X_1(\omega, \tau)}\right)\right\} \quad \text{Equation (1)}$$

In Equation (1), c represents the speed of sound, d represents the distance between the microphones, and arg represents an argument of a complex number.

The sound incoming direction $\theta(\omega, \tau)$ calculated by Equation (1) is obtained as an angle (radian measure) when the direction of the perpendicular bisector 13 of the first line segment 10 connecting the microphones 2*a* and 2*b* constituting the microphone pair 21 is 0 as shown in FIG. 2.

The band selecting unit 53 generates a filter $b(\omega, \tau)$, as represented by the following Equation (2), which leaves only the time-frequency component of the sound coming from the direction of the sound of interest on the basis of the sound incoming direction $\theta(\omega, \tau)$ for each discrete frequency calculated in step ST4 (step ST5). The band selecting unit 53 outputs the generated filter to the multiplication unit 54.

$$b(\omega, \tau) = \begin{cases} 1 & (\theta(\omega, \tau) \in \Theta) \\ 0 & (\text{otherwise}) \end{cases} \quad \text{Equation (2)}$$

In Equation (2), Θ represents a set of incoming directions of sounds of interest. By equation (2), a filter that multiplies the time-frequency component of the sound coming from a desired direction by 1 as a coefficient and multiplies the other sound components by 0 is generated. Due to the filter, only the time-frequency component of the sound of interest included in the observation signal is extracted.

The multiplication unit 54 multiplies the observation signal spectrum $X_1(\omega, \tau)$ of the microphone 2*a* converted in step ST3 by the filter $b(\omega, \tau)$ generated in step ST5, thereby generating an output signal spectrum $Y(\omega, \tau)$ from which noise is eliminated (step ST6). The multiplication unit 54 outputs the generated output signal spectrum $Y(\omega, \tau)$ to the IDFT unit 55.

In the example explained above, in the process of step ST6, the observation signal spectrum $X_1(\omega, \tau)$ of the microphone 2*a* is multiplied by the filter $b(\omega, \tau)$. However, the observation signal spectrum $X_2(\omega, \tau)$ of the microphone 2*b* may be multiplied by the filter $b(\omega, \tau)$, or an observation signal spectrum of any other microphone 2 may be multiplied by the filter $b(\omega, \tau)$.

The IDFT unit 55 converts the output signal spectrum $Y(\omega, \tau)$ generated in step ST6 into an output signal y(t) in time domain by discrete inverse Fourier transform (step ST7). The IDFT unit 55 outputs the output signal y(t) converted in step ST7 to the speaker 6 (step ST8). Thereafter, the process returns to step ST1 and the above-described process are repeated.

Due to the process described above, the speaker 6 outputs a sound from which noise is eliminated and in which distortion is suppressed. While the speaker 6 is described as an example in the above, the output destination of the IDFT unit 55 may be an earphone, a memory, a hard disk, or the like. When the output destination is a storage medium such as a memory or a hard disk, digital data of the sound from which noise is eliminated is stored in the storage medium.

When the microphone array 3 is constituted by three or more microphones 2, the band selecting unit 53 may generate a filter by using, for example, an average value of incoming directions of sounds observed by the plurality of microphone pairs 21. This enables noise elimination with higher accuracy.

As described above, according to the first embodiment, the noise elimination device 1 is configured to include: an microphone array 3 having a plurality of microphones 2 observing sound signals; and a noise elimination processing unit 5 obtaining a sound of interest by eliminating noise from the sound signals observed by the plurality of microphones 2. Two microphones 2 which are adjacent to each other from among the plurality of microphones 2 have a positional relationship in such a manner that, in a plane 12 including the two microphones 2, a sound-of-interest source A generating a sound of interest, and a noise source B generating noise, a perpendicular bisector 13 of a first line segment 10 connecting the two microphones 2 coincides with a bisector of an angle θ between a second line segment 14 connecting the sound-of-interest source A to a midpoint 11 of the first line segment 10 and a third line segment 15 connecting the noise source B to the midpoint 11 of the first line segment 10. Therefore, the noise elimination device 1 according to the first embodiment can suppress distortion in the output signal and can achieve high noise elimination performance. Thus, the clarity of the sound of interest is enhanced.

Second Embodiment

In a second embodiment, a noise elimination device having a configuration for performing an echo canceling process will be described.

Figure 9:
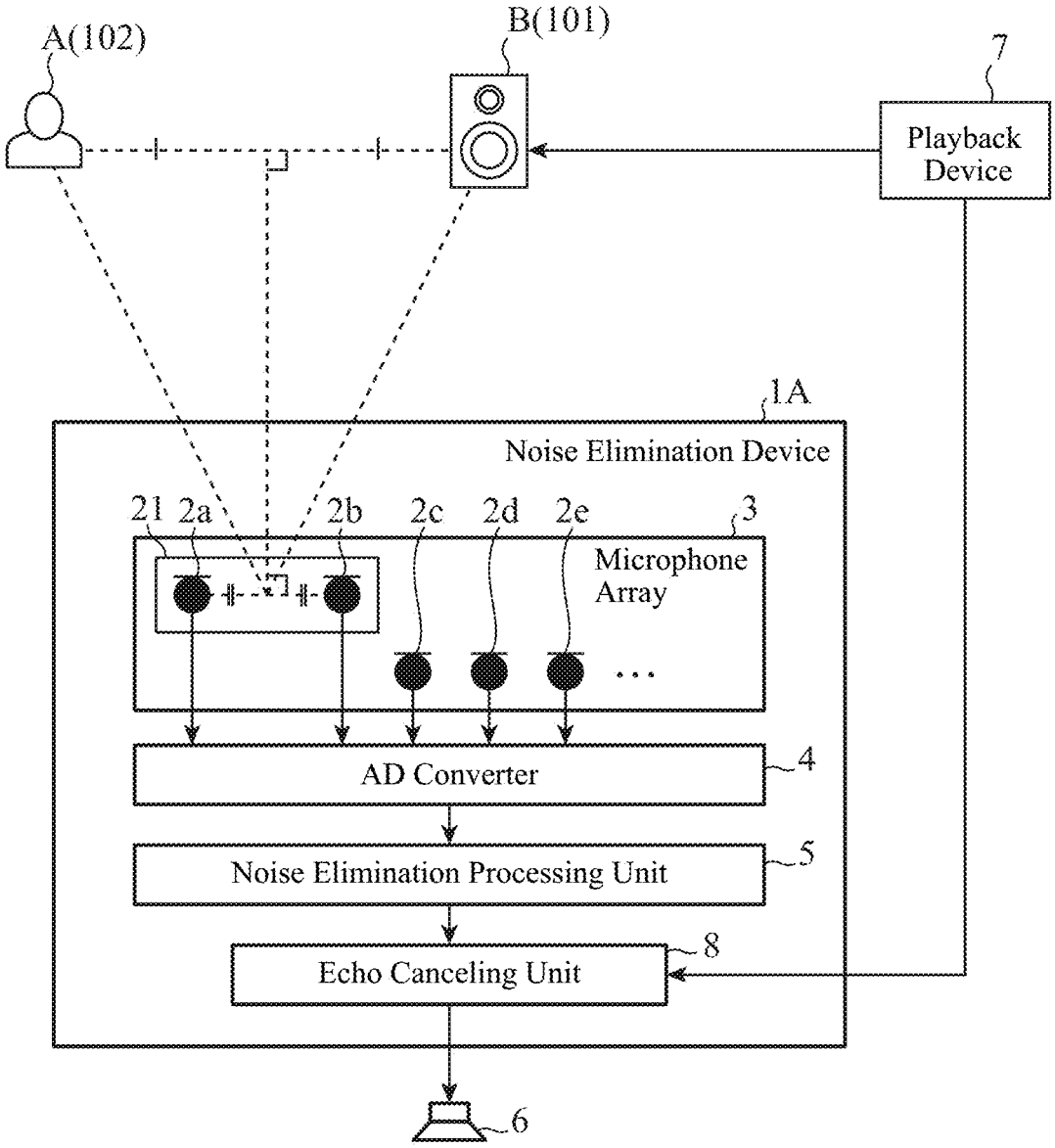
FIG. 9 is a diagram showing a configuration of a noise elimination device according to a second embodiment.

FIG. 9 is a diagram showing a configuration of a noise elimination device 1A according to the second embodiment of the present invention.

The noise elimination device 1A is configured by adding an echo canceling unit 8 to the noise elimination device 1 according to the first embodiment shown in FIG. 1. In the following, the elements same as or corresponding to those of the noise elimination device 1 according to the first embodiment are denoted by the same reference symbols as those used in the first embodiment, and the description thereof will be omitted or simplified.

As shown in FIG. 9, a playback device 7 is also connected to the noise elimination device 1A in addition to the speaker 6. For example, the playback device 7 performs, in a hands-free call system, a process for receiving a call partner's voice (hereinafter referred to as "call voice") and playing the received call voice on a playback speaker 101. When the call voice is played back on the playback speaker 101, the played call voice comes in a microphone for telephone communication (microphone array 3) of a speaking person 102, and the speaking person's voice is repeatedly played back like an echo and output from the speaker 6. The echo canceling unit 8 performs a process for avoiding a situation in which the speaker's voice is repeatedly played back like an echo.

In the noise elimination device 1A, a plurality of microphones 2 observes the call voice output from the playback speaker 101 and the voice of the speaking person 102. Further, the noise elimination device 1A performs the same process as that in the first embodiment, thereby eliminating the call voice output from the playback speaker 101 as noise from the observation signal, and obtaining an output signal of the voice of the speaking person 102 that is a sound of interest. Furthermore, the noise elimination device 1A performs an echo canceling process on the output signal of the voice of the speaking person on the basis of a reference signal of the playback device 7.

Suppose that at least one microphone pair 21 constituting the microphone array 3 is arranged in the positional relationship shown in FIG. 2 in the first embodiment. That is, the microphones 2*a* and 2*b* constituting the microphone pair 21 are arranged so that, in the plane 12 including the microphones 2*a* and 2*b*, the sound-of-interest source A, and the noise source B, the perpendicular bisector 13 of the first line segment 10 coincides with the bisector of the angle θ between the second line segment 14 connecting the sound-of-interest source A and the midpoint 11 of the first line segment 10 and the third line segment 15 connecting the noise source B and the midpoint 11.

The noise elimination processing unit 5 eliminates noise (echo component) output from the playback speaker 101 serving as the noise source B from the observation signal input from the microphones 2, as in the first embodiment. The noise elimination processing unit 5 outputs the output signal from which noise is eliminated to the echo canceling unit 8. In the noise elimination by the noise elimination processing unit 5, it is generally difficult to completely eliminate the echo component due to echo or other disturbance factors. In view of this, the echo canceling unit 8 eliminates a residual echo component from the output signal from the noise elimination processing unit 5.

The echo canceling unit 8 eliminates a residual echo component from the output signal input from the noise elimination processing unit 5 on the basis of the reference signal of the playback device 7. As a method for eliminating a residual echo component by the echo canceling unit 8 on the basis of the reference signal of the playback device 7, an LMS algorithm and an affine projection algorithm are known. The echo canceling unit 8 outputs an output signal from which the residual echo component is eliminated to the speaker 6. As a result, an output signal of the speaking person 102 from which the residual echo component is eliminated is output from the speaker 6.

Before the echo canceling unit 8 eliminates the residual echo component, the noise elimination processing unit 5 eliminates noise from the observation signal of the speaking person 102 output from the microphone pair 21 arranged in the positional relationship shown in FIG. 2, whereby performance of eliminating the residual echo component by the echo canceling unit 8 can be enhanced. Thus, in the output signal output from the speaker 6, the clarity of the voice of the speaking person 102, which is the sound of interest, is enhanced.

Next, the operation of the noise elimination device 1A will be described.

Figure 10:
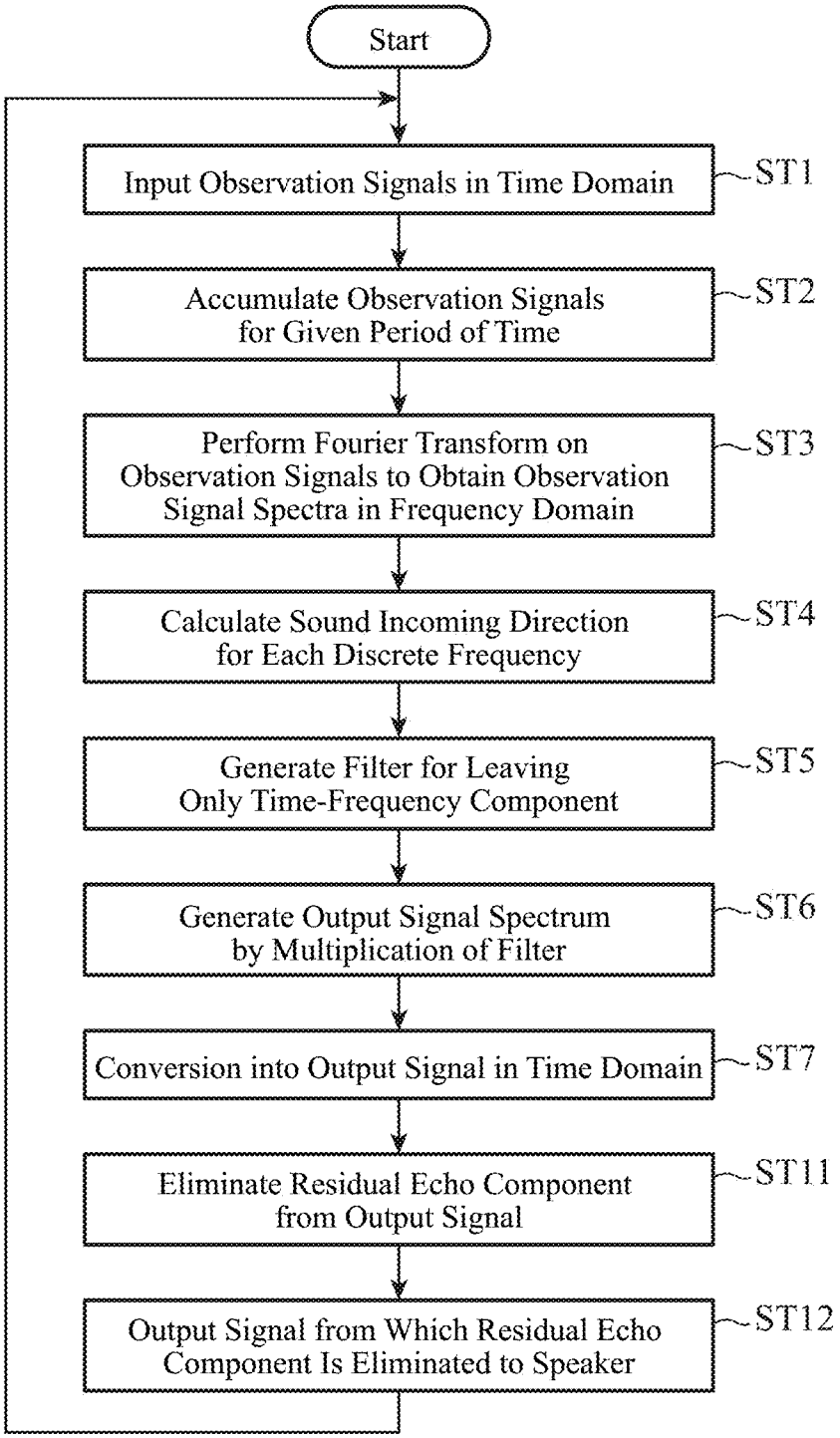
FIG. 10 is a flowchart showing an operation of the noise elimination device according to the second embodiment.

FIG. 10 is a flowchart showing the operation of the noise elimination device 1A according to the second embodiment of the present invention.

In the following, the same steps as those of the noise elimination device 1 in the first embodiment are denoted by the same reference symbols as those shown in FIG. 8, and the description thereof will be omitted or simplified.

In step ST7, when the IDFT unit 55 converts the output signal spectrum $Y(\omega, \tau)$ into the output signal y(t) in time domain by discrete inverse Fourier transform, the IDFT unit 55 outputs the converted output signal y(t) to the echo canceling unit 8. The echo canceling unit 8 eliminates a residual echo component from the output signal y(t) converted in step ST7 on the basis of the reference signal of the playback device 7, and generates an output signal z(t) (step ST11). The echo canceling unit 8 outputs the output signal z(t) generated in step ST11 to the speaker 6 (step ST12). Thereafter, the process returns to step ST1 and the above-described process is repeated.

As described above, according to the second embodiment, the noise elimination device 1A is configured such that the plurality of acoustic sensors 2 observe a sound signal of a call voice of a speaking person, and the noise elimination device 1A further includes an echo canceling unit 8 eliminating a residual echo component of the call voice from the sound of interest obtained by the noise elimination processing unit 5. Therefore, the noise elimination device 1A according to the second embodiment can enhance the performance of eliminating an echo component and enhance the clarity of voice of the speaking person which is the sound of interest.

Third Embodiment

In a third embodiment, a noise elimination device having a configuration for performing an abnormal sound detection process will be described.

Figure 11:
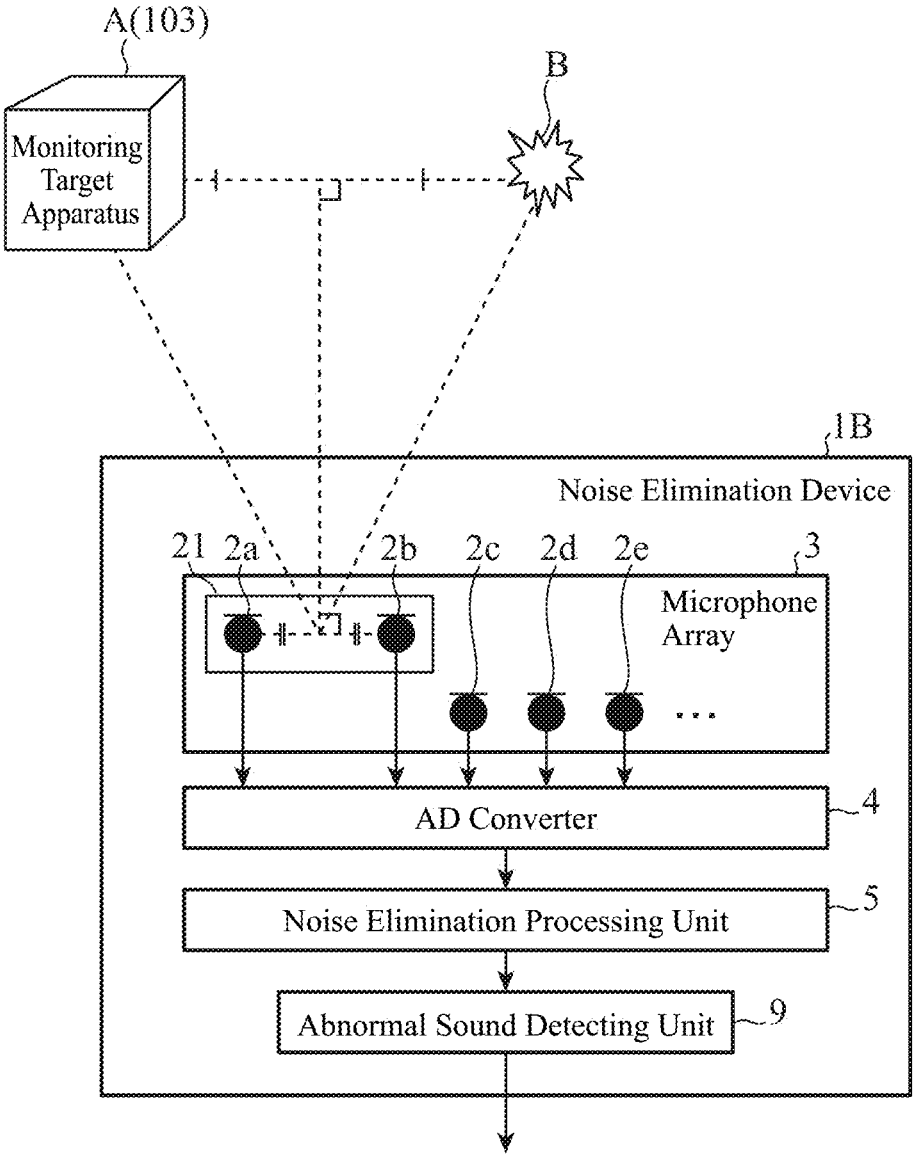
FIG. 11 is a diagram showing a configuration of a noise elimination device according to a third embodiment.

FIG. 11 is a diagram showing a configuration of a noise elimination device 1B according to the third embodiment of the present invention.

The noise elimination device 1B is configured by adding an abnormal sound detecting unit 9 to the noise elimination device 1 according to the first embodiment shown in FIG. 1. In the following, the elements same as or corresponding to those of the noise elimination device 1 according to the first embodiment are denoted by the same reference symbols as those used in the first embodiment, and the description thereof will be omitted or simplified.

As shown in FIG. 11, in the noise elimination device 1B, a plurality of microphones 2 observes an operating sound output from a monitoring target apparatus 103 and noise generated from a noise source B. Further, the noise elimination device 1B performs the process same as that in the first embodiment, thereby eliminating noise from an observation signal and obtaining an output signal of an operating sound of the monitoring target apparatus 103 which is a sound of interest. Furthermore, the noise elimination device 1B performs a process for detecting an abnormal sound from the operating sound of the monitoring target apparatus 103. The noise elimination device 1B according to the third embodiment is applicable to, for example, an apparatus monitoring system that constantly monitors the operating sound of an apparatus and detects an abnormal sound due to a malfunction or failure of the apparatus.

Suppose that at least one microphone pair 21 constituting the microphone array 3 is arranged in the positional relationship shown in FIG. 2 in the first embodiment. That is, the microphones 2*a* and 2*b* constituting the microphone pair 21 are arranged so that, in the plane 12 including the microphones 2*a* and 2*b*, the sound-of-interest source A, and the noise source B, the perpendicular bisector 13 of the first line segment 10 coincides with the bisector of the angle θ between the second line segment 14 connecting the sound-of-interest source A and the midpoint 11 of the first line segment 10 and the third line segment 15 connecting the noise source B and the midpoint 11.

The noise elimination processing unit 5 eliminates a signal obtained by eliminating noise from an observation signal input from the microphones 2 and obtains a sound signal of an operating sound of the monitoring target apparatus 103 which is a sound of interest, as in the first embodiment. The noise elimination processing unit 5 outputs the sound signal of the operating sound of the monitoring target apparatus 103 from which noise is eliminated to the abnormal sound detecting unit 9 as an output signal.

The abnormal sound detecting unit 9 detects an abnormal sound generated in the monitoring target apparatus 103 from the output signal input from the noise elimination processing unit 5. For example, the detection method disclosed in Reference Document 1 or Reference Document 2 can be applied to the process for detecting an abnormal sound by the abnormal sound detecting unit 9. The abnormal sound detecting unit 9 outputs a detection result indicating whether or not an abnormal sound is detected.

Reference Document 1: JP 2010-271073 A

Reference Document 2: JP 2008-76246 A

Before the abnormal sound detecting unit 9 performs the process for detecting an abnormal sound, the noise elimination processing unit 5 eliminates noise from the sound signal of the operating sound of the monitoring target apparatus 103 output from the microphone pair 21 arranged in the positional relationship shown in FIG. 2, whereby the accuracy of detecting the abnormal sound generated in the monitoring target apparatus 103 can be enhanced in various environments.

Next, the operation of the noise elimination device 1B will be described.

Figure 12:
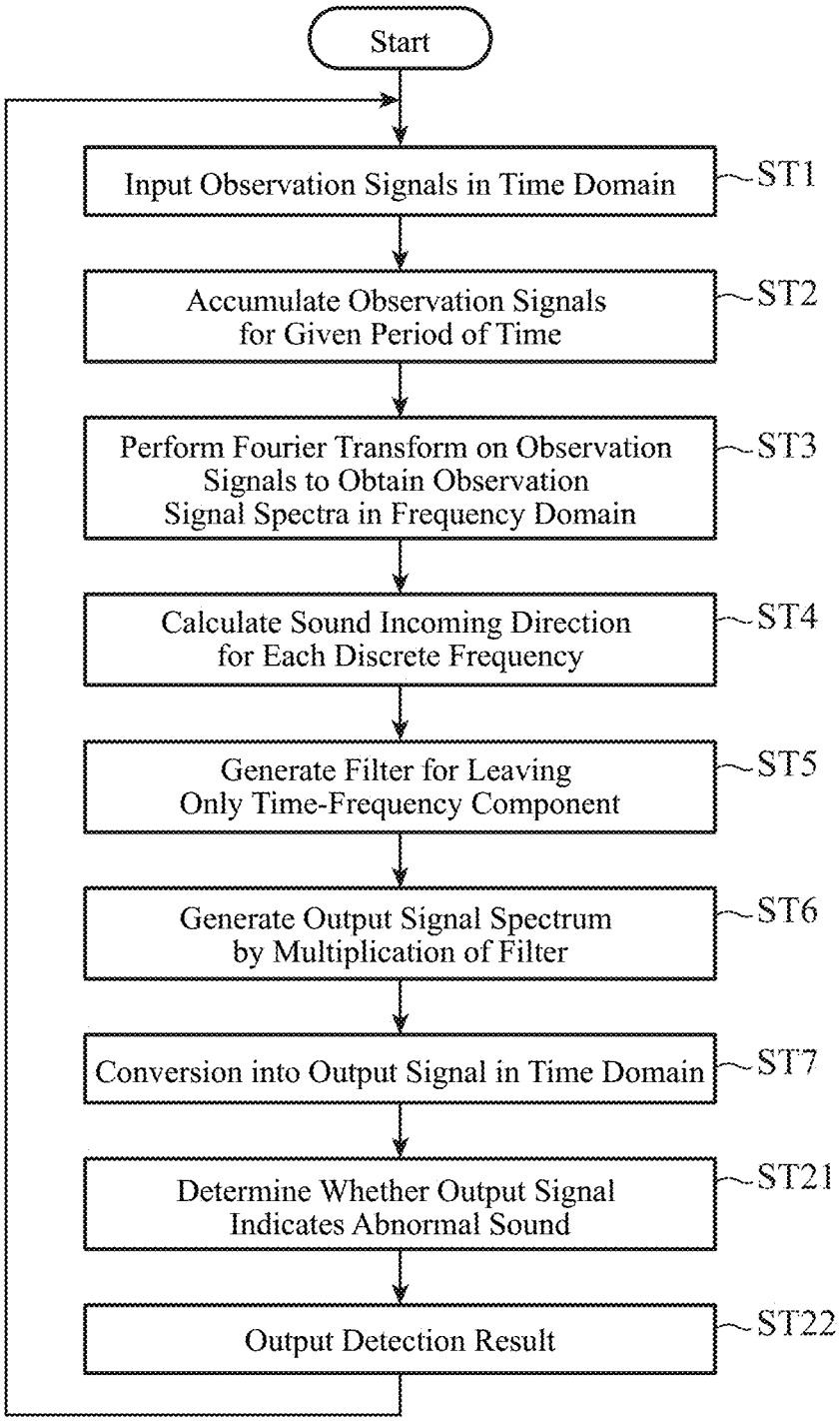
FIG. 12 is a flowchart showing an operation of a noise elimination device according to a fourth embodiment.

FIG. 12 is a flowchart showing the operation of the noise elimination device 1B according to the third embodiment of the present invention.

In the following, the same steps as those of the noise elimination device 1 in the first embodiment are denoted by the same reference symbols as those shown in FIG. 8, and the description thereof will be omitted or simplified.

In step ST7, when the IDFT unit 55 converts the output signal spectrum $Y(\omega, \tau)$ into the output signal y(t) in time domain by discrete inverse Fourier transform, the IDFT unit 55 outputs the converted output signal y(t) to the abnormal sound detecting unit 9. The abnormal sound detecting unit 9 determines whether or not the output signal indicates an abnormal sound by comparing the frequency of the output signal y(t) converted in step ST7 with a preset threshold value (step ST21). The abnormal sound detecting unit 9 outputs the determination result as to whether or not the output signal indicates an abnormal sound to an apparatus control device (not shown) or the like as a detection result (step ST22). Thereafter, the process returns to step ST1 and the above-described process is repeated.

Note that the process of the abnormal sound detecting unit 9 in step ST21 described above is merely an example, and other abnormal sound detection processes can be applied.

As described above, according to the third embodiment, the noise elimination device 1B is configured such that the plurality of microphones 2 observe a sound signal of an operating sound of a monitoring target apparatus 103, and the noise elimination device includes an abnormal sound detecting unit 9 detecting an abnormal sound generated in the monitoring target apparatus 103 by referring to the sound of interest obtained by the noise elimination processing unit 5. Therefore, the noise elimination device 1B according to the third embodiment can enhance the detection accuracy of abnormal sound in various environments.

In addition, when the abnormal sound detecting unit 9 detects an abnormal sound, for example, control for automatically stopping the monitoring target apparatus 103 and notifying an operator of a malfunction of the monitoring target apparatus 103 by an alarm or an email can be performed. Thus, it is possible to prevent the monitoring target apparatus 103 from operating for a long time in an unstable state.

Fourth Embodiment

A fourth embodiment describes an arrangement of the microphones 2 for accurately eliminating noise in a situation in which the range where the sound-of-interest source and the noise source exist can be shifted.

Figure 13A:
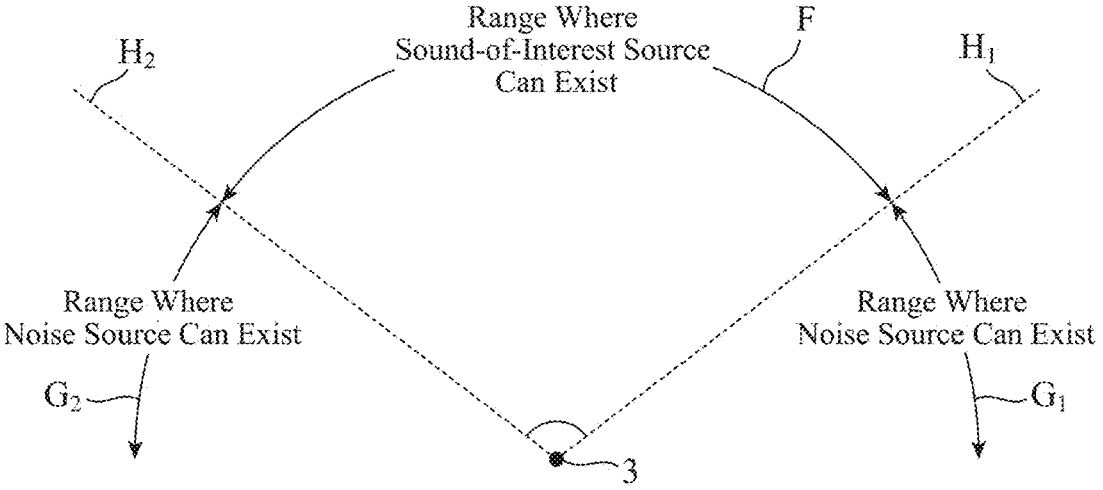
FIGS. 13A, 13B, and 13C are diagrams showing a positional relationship among microphones of the noise elimination device, a sound-of-interest source, and noise sources according to the fourth embodiment.
Figure 13B:
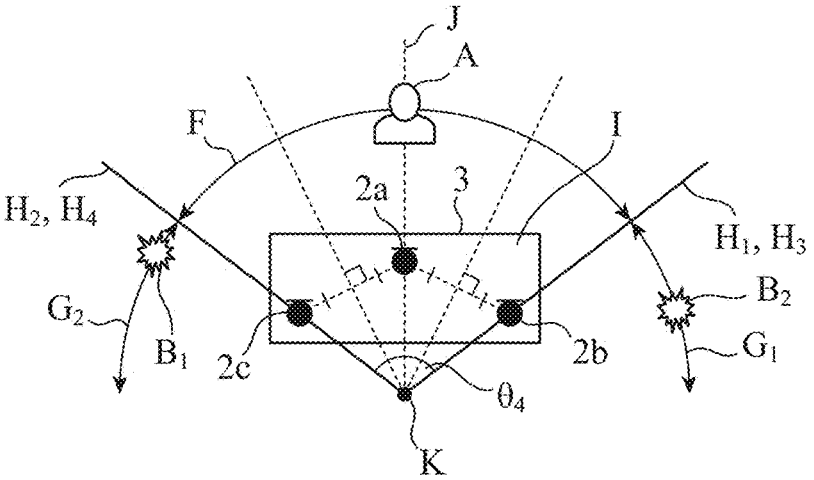
Figure 13C:
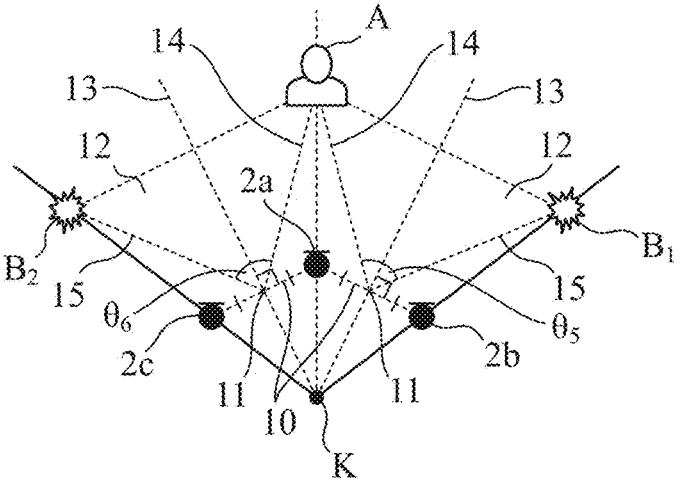

FIG. 13 shows diagrams illustrating a positional relationship among microphones 2 of a noise elimination device 1 and each of a sound-of-interest source A and noise sources $B_1$ and $B_2$ according to the fourth embodiment of the present invention. FIG. 13A is a diagram showing a positional relationship among the ranges in which the sound-of-interest source A and the noise sources $B_1$ and $B_2$ can exist and the microphone array 3. FIG. 13B is a diagram showing a positional relationship of three microphones 2*a*, 2*b*, and 2*c* constituting the microphone array 3. FIG. 13C is a diagram showing a positional relationship among the microphones 2*a*, 2*b*, 2*c*, the sound-of-interest source A, and the noise sources $B_1$ and $B_2$.

As shown in FIG. 13A, a range (hereinafter referred to as a range F of a direction of a sound-of-interest source) where the sound-of-interest source A can exist and ranges (hereinafter referred to as ranges of directions of noise sources) $G_1$ and $G_2$ where the noise sources $B_1$ and $B_2$ can exist are formed around the microphone array 3. The boundary between the range F of the direction of the sound-of-interest source and the range $G_1$ of the direction of the noise source is indicated by a boundary plane $H_1$ passing through the center of the microphone array 3. The boundary between the range F of the direction of the sound-of-interest source and the range $G_2$ of the direction of the noise source is indicated by a boundary plane Hz passing through the center of the microphone array 3. A plurality of sound-of-interest sources A may exist within the range F of the direction of the sound-of-interest source. Similarly, a plurality of noise sources $B_1$ may exist within the range $G_1$ of the direction of the noise source, and a plurality of noise sources $B_2$ may exist within the range $G_2$ of the direction of the noise source.

Next, the arrangement of the microphones 2 constituting the microphone array 3 will be described with reference to FIG. 13B. Suppose that the three microphones 2 constituting the microphone array 3 are located in a plane I. An intersection line between the plane I and the boundary plane $H_1$ is defined as a boundary line $H_3$, and an intersection line between the plane I and the boundary plane $H_2$ is defined as a boundary line $H_4$. In the plane I, the middle microphone 2*a* (first acoustic sensor) of the three microphones 2 is disposed on the bisector J of the angle $\theta_4$ formed by the boundary line $H_3$ and the boundary line $H_4$. The microphone 2*b* (second acoustic sensor) adjacently located on one side of the microphone 2*a* is disposed on the boundary line $H_3$. The microphone 2*c* (third acoustic sensor) adjacently located on the other side of the microphone 2*a* is disposed on the boundary line $H_4$.

The triangle formed by connecting the intersection point K where the boundary line $H_3$ and the boundary line $H_4$ intersect, the center of the microphone 2*a*, and the center of the microphone 2*b* is an isosceles triangle in which the length of the line segment connecting the intersection point K and the center of the microphone 2*a* is equal to the length of the line segment connecting the intersection point K and the center of the microphone 2*b*.

Similarly, the triangle formed by connecting the intersection point K, the center of the microphone 2*a*, and the center of the microphone 2*c* is an isosceles triangle in which the length of the line segment connecting the intersection point K and the center of the microphone 2*a* is equal to the length of the line segment connecting the intersection point K and the center of the microphone 2*c*.

As shown in FIG. 13C, when the sound-of-interest source A is located on the bisector J and the noise source $B_1$ is located on the boundary line $H_3$, the sound-of-interest source A, the noise source $B_1$, and the microphones 2*a* and 2*b* satisfy the relationship shown in the first embodiment.

As shown in FIG. 13C, the midpoint of the first line segment 10 connecting the microphone 2*a* and the microphone 2*b* is defined as a midpoint 11. In the plane 12 on which the microphone 2*a*, the microphone 2*b*, the sound-of-interest source A, and the noise source $B_1$ exist, the perpendicular bisector 13 that perpendicularly bisects the first line segment 10 coincides with the bisector of the angle $\theta_5$ between the second line segment 14 connecting the sound-of-interest source A and the midpoint 11 and the third line segment 15 connecting the noise source $B_1$ and the midpoint 11.

Further, as shown in FIG. 13C, the midpoint of the first line segment 10 connecting the center of the microphone 2*a* and the center of the microphone 2*c* is defined as a midpoint 11. In the plane 12 on which the microphone 2*a*, the microphone 2*c*, the sound-of-interest source A, and the noise source $B_2$ exist, the perpendicular bisector 13 of the first line segment 10 coincides with the bisector of the angle $\theta_6$ between the second line segment 14 connecting the sound-of-interest source A and the midpoint 11 and the third line segment 15 connecting the noise source $B_2$ and the midpoint 11.

Note that the distance between the microphone array 3 and the sound-of-interest source A or the distance between the microphone array 3 and the noise sources $B_1$ and $B_2$ is sufficiently longer than the distance among the microphones 2*a*, 2*b*, and 2*c*. Although it is described that the microphone array 3 is constituted by the three microphones 2 arranged as described above, the microphone array 3 may include at least the three microphones 2 arranged as described above.

As with the first embodiment, the AD converter 4 converts the observation signal of sound observed by the microphone array 3 including the microphones 2 arranged as described above into a digital signal, and the noise elimination processing unit 5 obtains an output signal by eliminating noise. Further, the noise elimination device 1 may be configured in such a manner that, by using the configuration of the second embodiment, the echo canceling unit 8 eliminates a residual echo component from the output signal obtained by eliminating noise by the noise elimination processing unit 5. Further, the noise elimination device 1 may be configured in such a manner that, by using the configuration of the third embodiment, the abnormal sound detecting unit 9 performs the process for detecting an abnormal sound on the output signal obtained by eliminating noise by the noise elimination processing unit 5.

As described above, according to the fourth embodiment, the noise elimination device includes: a microphone array 3 having three or more microphones 2 observing sound signals; and a noise elimination processing unit 5 obtaining a sound of interest by eliminating noise from the sound signals observed by the three or more microphones 2. In a plane I where three microphones 2 which are adjacent to each other from among the three or more microphones 2 are positioned, a microphone 2*a* is arranged on a bisector J of an angle between two boundary lines $H_3$ and $H_4$ indicating boundaries between a range F of a direction of a sound-of-interest source where a sound-of-interest source generating the sound of interest can exist, and ranges of directions of noise sources $G_1$ and $G_2$ where the noise sources generating noises can exist, while microphones 2*b*, 2*c* are arranged on the two boundary lines $H_3$ and $H_4$, respectively, and when the sound-of-interest source A is located on a bisector of an angle $\theta_4$ between the two boundary lines $H_3$ and $H_4$, and the noise sources $B_1$ and $B_2$ are located on the two boundary lines $H_3$ and $H_4$, respectively, the microphones 2*a*, 2*b*, 2*c* have a positional relationship in such a manner that, in a plane 12 including two microphones 2 which are adjacent to each other, the sound-of-interest source A, and the noise source B, a perpendicular bisector 13 of a first line segment 10 connecting the two microphones coincides with a bisector of an angle $\theta_5$ and $\theta_6$ between a second line segment 14 connecting the sound-of-interest source A and a midpoint 11 of the first line segment 10 and a third line segment 15 connecting the noise source B and the midpoint 11 of the first line segment 10.

Therefore, the noise elimination device according to the fourth embodiment can maximize the noise elimination performance in a situation where it is most difficult to clarify the sound of interest, that is, in a case where the noise source is located on the boundary line, between the range of the direction of the sound-of-interest source and the range of the direction of the noise source, at which the noise source is closest to the sound-of-interest source. Thus, according to the noise elimination device of the fourth embodiment, stable noise elimination performance can be achieved wherever the noise source is located within the range of the direction of the noise source.

The noise elimination device including the microphone array 3 constituted by the three microphones 2 shown in the fourth embodiment is expected to be used in, for example, a shotgun microphone or a conference system.

It is to be noted that, besides the above, two or more of the above embodiments can be freely combined, or any components in the respective embodiments can be modified or omitted, within the scope of the present invention.

INDUSTRIAL APPLICABILITY

The noise elimination device according to the present invention can be used in an apparatus for separating ambient noise or the like from sounds including not only sounds coming from a desired direction but also the ambient noise or the like.

REFERENCE SIGNS LIST

1, 1A, 1B: noise elimination device, 2, 2*a*, 2*b*, 2*c*, 2*d*, 2*e*, 2*f*: microphone, 3: microphone array, 4: AD converter, 5: noise elimination processing unit, 8: echo canceling unit, 9: abnormal sound detecting unit, 21: microphone pair, 51, 52: DFT unit, 53: band selecting unit, 54: multiplication unit, 55: IDFT unit

The invention claimed is:

1. A noise elimination device comprising:

an acoustic sensor array having a plurality of acoustic sensors observing sound signals; and processing circuitry to obtain a sound of interest by eliminating noise from the sound signals observed by the plurality of acoustic sensors, wherein two acoustic sensors which are adjacent to each other from among the plurality of acoustic sensors have a positional relationship in such a manner that, in a plane including the two acoustic sensors, a sound-of-interest source generating a sound of interest, and a noise source generating noise, a perpendicular bisector of a first line segment connecting the two acoustic sensors coincides with a bisector of an angle between a second line segment connecting the sound-of-interest source to a midpoint of the first line segment and a third line segment connecting the noise source to the midpoint of the first line segment.

2. The noise elimination device according to claim 1, wherein the plurality of acoustic sensors observe a sound signal of a call voice of a speaking person, and the processing circuitry is configured to eliminate a residual echo component of the call voice from the sound of interest.

3. The noise elimination device according to claim 1, wherein the plurality of acoustic sensors observe a sound signal of an operating sound of a monitoring target apparatus, and the processing circuitry is configured to detect an abnormal sound generated in the monitoring target apparatus by referring to the sound of interest.

4. A noise elimination device comprising:

an acoustic sensor array having three or more acoustic sensors observing sound signals; and processing circuitry to obtain a sound of interest by eliminating noise from the sound signals observed by the three or more acoustic sensors, wherein, in a plane where three acoustic sensors, which include a first, a second, and a third acoustic sensors, which are adjacent to each other from among the three or more acoustic sensors are positioned, a first acoustic sensor is arranged on a bisector of an angle between two boundary lines indicating boundaries between a range of a direction of a sound-of-interest source where a sound-of-interest source generating the sound of interest can exist, and ranges of directions of noise sources where the noise sources generating noises can exist, while a second acoustic sensor and a third acoustic sensor are arranged on the two boundary lines, respectively, and when the sound-of-interest source is located on a bisector of an angle between the two boundary lines, and the noise sources are located on the two boundary lines, respectively, the first acoustic sensor, the second acoustic sensor, and the third acoustic sensor have a positional relationship in such a manner that, in a plane including two acoustic sensors included in the first to third acoustic sensors and which are adjacent to each other, the sound-of-interest source, and the noise source, a perpendicular bisector of a first line segment connecting the two acoustic sensors coincides with a bisector of an angle between a second line segment connecting the sound-of-interest source and a midpoint of the first line segment and a third line segment connecting the noise source and the midpoint of the first line segment.

5. A noise elimination method comprising:

arranging, in a plane including two acoustic sensors which constitute an acoustic sensor array and which are adjacent to each other, a sound-of-interest source generating a sound of interest, and a noise source generating noise, the two acoustic sensors in a positional relationship in such a manner that a perpendicular bisector of a first line segment connecting the two acoustic sensors coincides with a bisector of an angle between a second line segment connecting the sound-of-interest source to a midpoint of the first line segment and a third line segment connecting the noise source to the midpoint of the first line segment;

observing a sound signal by the two acoustic sensors; and obtaining the sound of interest by eliminating noise from the sound signal.

* * * * *